US006436556B1

(12) United States Patent
Bleck et al.

(10) Patent No.: US 6,436,556 B1
(45) Date of Patent: Aug. 20, 2002

(54) METHOD FOR PRODUCING A STRIP-LIKE METAL COMPOSITE BY HIGH TEMPERATURE DIP COATING

(75) Inventors: Wolfgang Bleck, Aachen; Rolf Bünten, Düsseldorf; Frank Friedel, Moers; Oliver Picht, Aachen; Wolfgang Reichelt, Moers; Wilhelm Schmitz, Baesweiler; Dieter Senk, Duisburg; Paul Splinter, Aachen; Ulrich Urlau, Moers, all of (DE)

(73) Assignees: SMS Demag AG; Thyssen Krupp Stahl AG, both of Düsseldorf (DE)

( * ) Notice: Subject to any disclaimer, the term of this patent is extended or adjusted under 35 U.S.C. 154(b) by 0 days.

(21) Appl. No.: 09/581,888

(22) PCT Filed: Dec. 15, 1998

(86) PCT No.: PCT/DE98/03764

§ 371 (c)(1),
(2), (4) Date: Aug. 11, 2000

(87) PCT Pub. No.: WO99/32683

PCT Pub. Date: Jul. 1, 1999

(30) Foreign Application Priority Data

Dec. 19, 1997 (DE) ..... 197 58 140

(51) Int. Cl.[7] ..... B32B 15/18; B05D 1/18; B05C 11/00

(52) U.S. Cl. ..... 428/681; 118/666; 118/667; 118/694; 118/44; 118/718; 118/719; 118/620; 118/641; 118/72; 118/73; 118/404; 118/405; 148/516; 148/529; 148/534; 148/537; 427/432; 427/434.2; 427/436; 427/301; 427/318; 427/319; 428/610; 428/682; 428/684; 428/685; 428/925; 428/926; 428/939; 428/941

(58) Field of Search ..... 428/681, 682, 428/684, 685, 610, 925, 926, 939, 941; 148/516, 529, 534, 537; 427/432, 434.2, 436, 301, 318, 319; 118/666, 667, 694, 44, 718, 719, 620, 641, 72, 73, 404, 405

(56) References Cited

U.S. PATENT DOCUMENTS

| | | | | |
|---|---|---|---|---|
| 1,552,041 | A | * | 9/1925 | Crapo |
| 1,726,652 | A | * | 9/1929 | Crapo |
| 3,483,030 | A | * | 12/1969 | Clarke |

FOREIGN PATENT DOCUMENTS

| | | | | |
|---|---|---|---|---|
| DE | 3835393 | A1 | * | 9/1989 |
| FR | 2661426 | A1 | * | 10/1991 |
| GB | 422512 | A | * | 1/1935 |
| GB | 424373 | A | * | 2/1935 |
| GB | 929262 | A | * | 6/1963 |
| GB | 1396419 | A | * | 6/1975 |
| JP | 53-127333 | A | * | 11/1978 |
| JP | 58-110665 | A | * | 7/1983 |
| JP | 61-166986 | A | * | 7/1986 |
| WO | WO-97/21846 | A1 | * | 6/1997 |

* cited by examiner

*Primary Examiner*—Robert R. Koehler
(74) *Attorney, Agent, or Firm*—Cohen, Pontani, Lieberman & Pavane

(57) ABSTRACT

The invention relates to a method and a device for the production of a strip-like metallic composite material by the high-temperature dip coating of a metallic carrier strip, consisting of a metallurgic vessel for receiving the liquid depositing material, through which the carrier strip is capable of being led in a preferably vertical run-through direction by means of pairs of rollers arranged on the entry and the exit side, and of a preheating device for the carrier strip, said preheating device being located upstream of the metallurgic vessel. At the same time, the preheating device (41) is arranged in a housing (61) which is arranged in the entry region upstream of the metallurgic vessel (11) and surrounds the carrier strip (21) and into which the medium coming from a media supply (52) is capable of being introduced via at least one feed (51) led into the housing.

24 Claims, 4 Drawing Sheets

METHOD FOR PRODUCING A STRIP-LIKE METAL COMPOSITE BY HIGH TEMPERATURE DIP COATING

BACKGROUND OF THE INVENTION

The invention relates to a method for the production of a strip-like metallic composite material by the high-temperature dip coating of a metallic carrier strip, onto the surface of which a thin layer of a melted metallic depositing material is crystallized by solidifIcation when the carrier strip is being led through this depositing material, the latter being different from the material of the carrier strip, to a device for carrying out the method and to a product produced by this method.

EP 0 467 749 B1 discloses a method for the dip coating of a strip consisting of ferritic stainless steel with aluminum, in which the strip is heated in a nonoxidizing atmosphere in various steps at different temperatures, until the strip is finally dipped into a coating bath.

EP 0 397 952 B1 discloses a method for the continuous hot dip coating of stainless steel strip with aluminum, in which the strip is led, in an argon-scavenged housing, past a row of magnetic current devices, the strip is cleaned by argon plasmatron discharge, while at the same time being heated to the temperature required for dip coating, and the cleaned strip is dipped into a bath of melted aluminum.

In both methods mentioned above, therefore, aluminum is bonded to steel.

Moreover, DE 195 45 259 A1 discloses a method and a device for the production of thin metal strands, in which a metal strip is led vertically through a steel melt and at the same time has crystallized on it a layer thickness of 20–2% of the initial metal strip. Depending on thickness, the metal strip is preheated to a temperature between room temperature and a maximum of 900° C. By means of this method, composite metal sheets are produced, in which one of the materials used is a stainless steel or an austenitic or ferritic steel.

More detailed investigations show that the expected reliably reproducible results of the bond between parent sheet and coating are not achieved in the methods disclosed hitherto.

The object of the present invention is to provide a method, a device and a product, in which an Intimate fault-free bond of the individual layers of the composite material consisting of different materials is obtained by simple means.

SUMMARY OF THE INVENTION

The above stated object is obtained by the present invention. In the invention a carrier strip is preheated on its surface before being led through the melted depositing material and is pretreated by the addition or incorporation of chemical elements, in such a way that, while the carrier strip is being led through the depositing material, a binding region consisting of a gradient material is obtained by means of diffusion actions between the pretreated surface of the carrier strip and the crust crystallizing on the surface of the carrier strip, the liquidus temperature of the gradient material being, at least in parts of this bending region, below the liquidus temperature of the carrier strip material and of the depositing material.

After the carrier strip has been dipped into the metal melt, a chill crust, which at first still has no bond with the carrier strip, solidifies on the surface within a very short time due to the subcooling which is established and the good foreign nuclei conditions. As a result of diffusion actions during and after the dipping operation, concentration profiles are established in he binding region between the crust and carrier strip and give rise to local alloying with a defined chemical composition. A gradient material with a changing chemical composition occurs along the binding region itself. The local concentrations cause a lowering of the liquidus temperature (calculation according to Wensel and Roeser) which, in parts of the binding region, is below the liquidus temperature of both the carrier strip and the depositing material. The drop in the liquidus temperature is usually accompanied by an even greater decrease in the solidus temperature. It is thus possible for liquid phase fractions to be present in the binding region, even though the carrier strip material and depositing material are in the solid state of aggregation. The liquid phase fractions ensure welding between the basic material and depositing material.

In one embodiment of the invention, a strip-like metallic composite material, comprising: a stainless steel strip; a markedly thinner layer of metallic depositing material crystallized onto the strip wherein the coating on at least one side of the strip has a thickness ($d_A$) of $d_A$=(0.01 to 0.3)×D wherein D is the thickness of the steel strip and, wherein a binding layer has a thickness ($d_B$) of $d_B$=5 to 150 $\mu$m, and wherein the binding layer has a toothed line which additionally bonds positively the binding layer to be assigned both to the parent strand and to the depositing layer, and wherein there is a continuous transfer of alloying elements between the steel strip and the coating material.

The actions described above are illustrated in FIG. 4. The profile of the local liquidus and solidus temperatures is illustrated diagrammatically there in a graph in which the temperature is plotted against the space coordinate. The profile of the temperatures $T_{liq}$ and $T_{sol}$ makes clear the existence of liquid phase in the binding region, the basic material (carrier strip) and depositing material being in the solid state of aggregation.

It is necessary to ensure, for the purpose of reliable bonding, that the carrier strip is not too cold, and, on the other hand, the temperature cannot be selected so high that the carrier strip is melted down in the melting bath or loses strength to an extent such that it tears during transport. It was found, surprisingly, that the core of the carrier strip can be kept at an appropriate temperature, while, for the desired intimate bond, the liquidus temperature can be lowered, at least on the strip surface, in order thereby to allow diffusion-supported intermixing in the liquid state.

In advantageous developments, the invention shows various means which assist diffusion alloying in the binding region. These means may already be incorporated in the carrier strip, but they may also be applied, in assistance or alone, to the strip from outside, in that, according to the invention, the carrier strip, for the preparation of its surface, is led through a medium which contains the corresponding chemical elements penetrating at least partially into the surface.

At the same time, according to one aspect of the invention, the medium may be a gas, such as nitrogen, hydrogen, carbon monoxide, ammonia or carbon dioxide, or, according to another embodiment of the invention, a liquid, such as sulfuric acid, liquid ammonia or liquid nitrogen. It is also possible for the medium to be a solid, such as a cyanogen salt, carbonate or potassium ferrocyanide.

According to an advantageous embodiment of the invention, the carrier strips consists of steel which has a carbon content >20 ppm or a nitrogen content >20 ppm in the region of its surface.

Advantageously, the transport speed of the carrier strip and/or its penetration depth or penetration length into the liquid depositing material is set in such a way that a minimum dipping time of 50 msec is maintained, an upper limit being placed on the total dipping time by the desired layer thickness and the risk, already described above, of the carrier strip being melted down.

According to a further embodiment of the method of the invention, the surface of the carrier strip is roughened before penetration into the liquid depositing material.

In a preferred embodiment of the method of the invention the carrier strip is a carbon-containing steel which is preheated to a temperature of $T_{pre}$>900° C. at least on its surface. The depositing material is most advantageously a high-alloyed steel, in particular a chromium-alloyed steel.

The apparatus for the production of a strip-like metallic composite material by the method of the invention, consists of a metallurgic vessel for receiving the liquid depositing material, through which the carrier strip can be led in a preferably vertical run-through direction by means of pairs of rollers arranged on the entry and the exit side, and of a preheating device for the carrier strip. The preheating device is located upstream of the metallurgic vessel. According to the invention, the preheating device is arranged in a housing which is arranged in the entry region upstream of the metallurgic vessel and surrounds the carrier strip. The medium coming from a media supply is capable of being introduced via at least one feed entering the housing.

The form of the vessel through which the carrier strip is led may be selected as desired. Suitable apparatus includes dip tanks with deflecting rollers or containers with a bottom passage for the carrier strip. In the latter, the carrier strip is led vertically through the casting container. Such containers have an advantage inasmuch as, here, the penetration length and strip speed, as parameters, can be maintained as a function of the strip temperature with a high degree of reliability, since the bath height in the vessel can be set in a particularly simple and operationally expedient way.

In a particularly simple and compact apparatus for the production of a metal strand of a composite material by the method of the invention, the carrier strip is introduced into the melting bath directly out of a nonoxidizing environment. This operation may be performed by means of a housing which projects partially into the melt or, in the case of a vessel with a bottom orifice, may be performed by means of direct mounting underneath the bottom of the vessel.

When a carrier strip having the alloying agents already contained in it is used, a preheating device and a media feed, by means of which gas, preferably inert gas, is led into the housing interior, are sufficient.

Insofar as, additionally, solid or liquid media or else solely gaseous media, such as nitrogen, hydrogen, carbon monoxide or carbon dioxide, are applied to the surface of the carrier strip, either the feed is provided with blow nozzles, by means of which the gaseous medium can be injected into the interior of the housing and/or onto the surface of the carrier strip, or the feed is provided with spray nozzles, by means of which the liquid medium, for example sulfuric acid, liquid ammonia or liquid nitrogen, can be sprayed onto the surface of the carrier strip.

However, solids or pourable materials may also be used for lowering the liquidus temperature of the carrier strip, such as cyanogen salt, carbonate or potassium ferrocyanide. When pourable materials are used, these are introduced via a feed and are brought into contact with the surface of the carrier strip, and the strip, when being led past the runners, entrains the solid.

According to the invention, the medium may also take the form of a rechargeable solid body and be pressed against the surface of the carrier strip. The solids are shaped, for example, as a block which is pressed under appropriate pressure against the surface of the carrier strip.

In a further advantageous embodiment, measuring elements are used for detecting the melt temperature and the temperature and speed of the carrier strip. The measuring elements control via a processor at least one actuator for setting the speed of the carrier strip.

Furthermore, the bath height is also detected and is likewise supplied to a computer for processing. A highly accurate and reliable bath height setting can be achieved, for example by means of a vacuum container.

The carrier strip can be set, in particular by controlling the content of alloying elements, such as C, or else other alloying elements at grain boundaries, such as N, in such a way that local lowerings of the liquidus temperature occur, with the result that the binding layer has a tooth-like bonding line. This toothed line reinforces positively the intimate metallic bond which is already present.

The various features of novelty which characterize the invention are pointed out with particularity in the claims appended to and forming a part of this specification. For a better understanding of the invention, its operating advantages and specific objects obtained by its use, reference should be had to the accompanying drawings and descriptive matter in which there is illustrated and described a preferred embodiment of the invention.

DESCRIPTION OF PREFERRED EMBODIMENT

Figure 1:
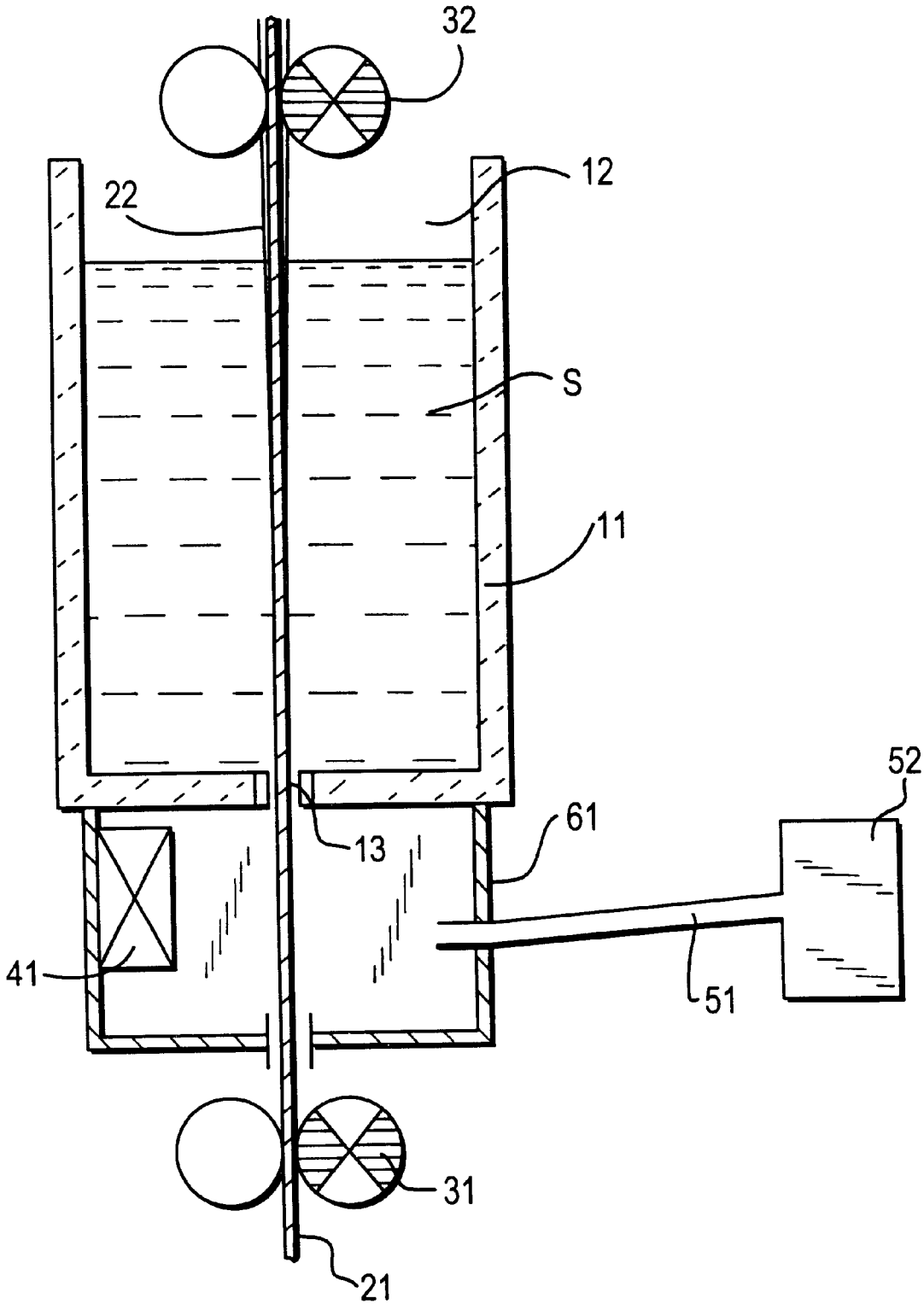
FIG. 1 shows a metallurgic vessel with a bottom passage orifice.

Referring to FIG. 1, a carrier strip 21 is led through a bottom passage 13 of a metallurgic vessel 11 into a melt S. Beneath the bottom of the metallurgic vessel 11 is provided a housing 61, in which a preheating device 41 is arranged. A media feed 51 connected to a media supply 52 is introduced into housing 61. The carrier strip 21 is led via a pair of feed rollers 31 through housing 61 and the bottom passage 13 into the metallurgic vessel 11, and the coated carrier strip 22 is conveyed out of the metallurgic vessel 11 and discharged via a pair of discharge rollers 32 provided at the exit 12 of the metallurgic vessel 11.

The metallurgic vessel of FIG. 1 may also be designed differently, for example as a dip vessel, into which the carrier strip is introduced from above and, after being deflected around a roller arranged in the melting bath, is discharged in an upward direction.

Figure 2:
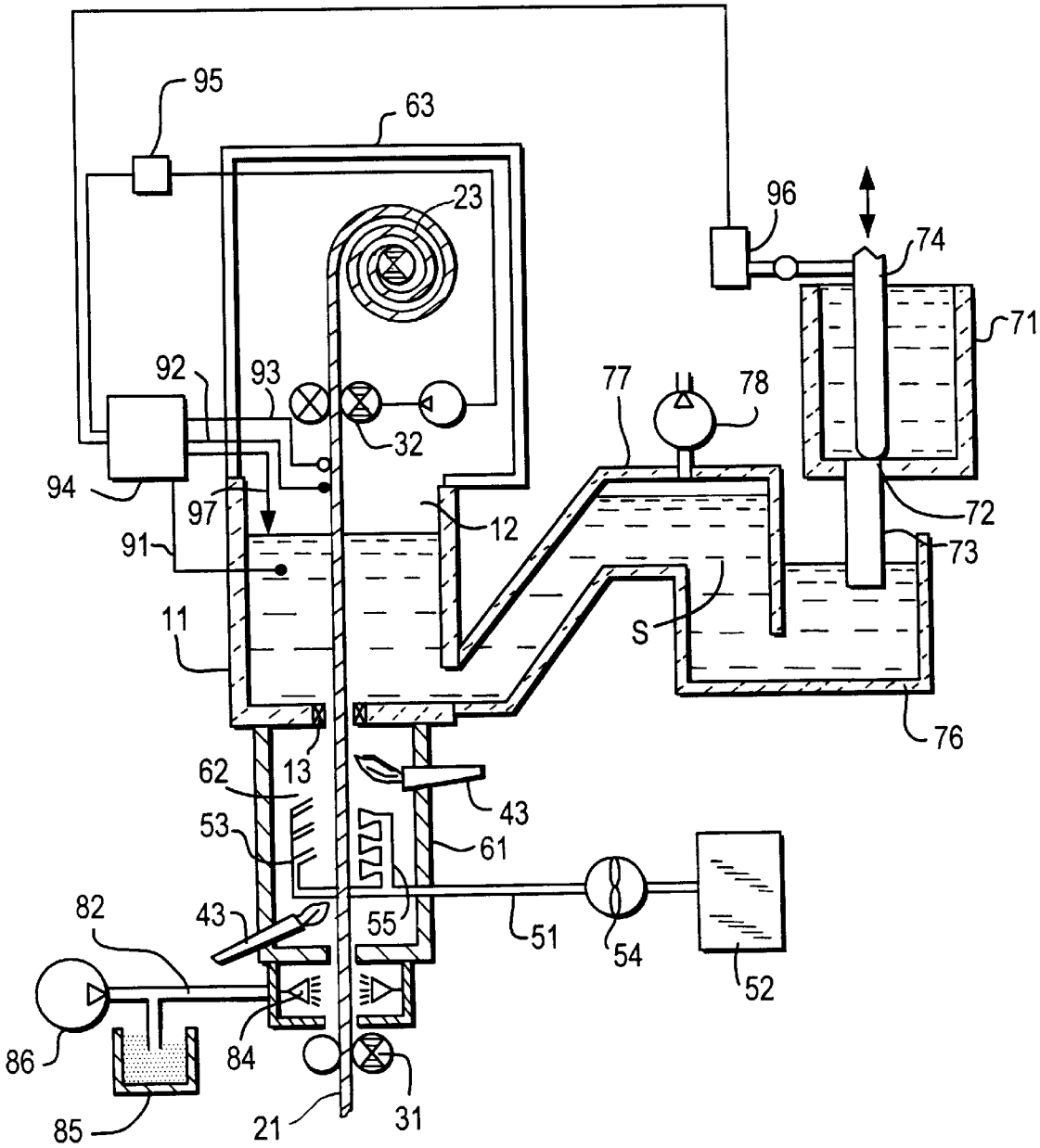
FIG. 2 shows a metallurgic vessel with a gaseous or liquid media feed.

In FIG. 2, like parts are designated in the same way. In addition to the above described elements of FIG. 1. FIG. 2 shows a media feed 51 for gaseous or liquid media which, coming from the media supply 52, are capable of being introduced into the housing 61 with the aid of a media conveyor 54. Blow nozzles 53 are employed when gaseous media are used and spray nozzles 55 in the case of liquid media.

In FIG. 2, the preheating device provided is a burner 43 which may be arranged downstream of the spray or blow nozzles 53, 55 (right side of the diagram) or upstream of these (left side of the diagram) in the strip conveying direction.

FIG. 2 indicates, at 82, a sandblaster, by means of which the blasting medium is administered to the surface of the carrier strip via blast nozzles 84. In this case, the blasting medium is extracted from the container 85 and is conveyed via a pump 86.

The upper orifice 12 of the metallurgic vessel 11 is covered by a hood 63 which encloses the discharge rollers 32 and a winding device 23.

The melt S is added with a low degree of flow to the metallurgic vessel in the region of the bottom, a vacuum distributor 77 being used which is connected to a vacuum pump 78.

By means of a ladle 71, the bottom orifice 72 of which is capable of being closed by means of a plug 74, melt is led into a receiving vessel 76 of the vacuum distributor 77 through an immersion-type casting spout 73.

FIG. 2 illustrates diagrammatically, as a measuring and regulating device, a processor 94 which is connected to temperature measuring elements 91 for detecting the melt temperature, to temperature measuring elements 92 for detecting the temperature of the carrier strip 21 and to measuring elements for detecting the speed 93 and for detecting the bath height 97.

The processor 94 acts via actuators 95 on the strip speed and via an actuator 96 on the plug 74 and therefore essentially on the bath height of the melt S located in the metallurgic vessel 11.

Figure 3:
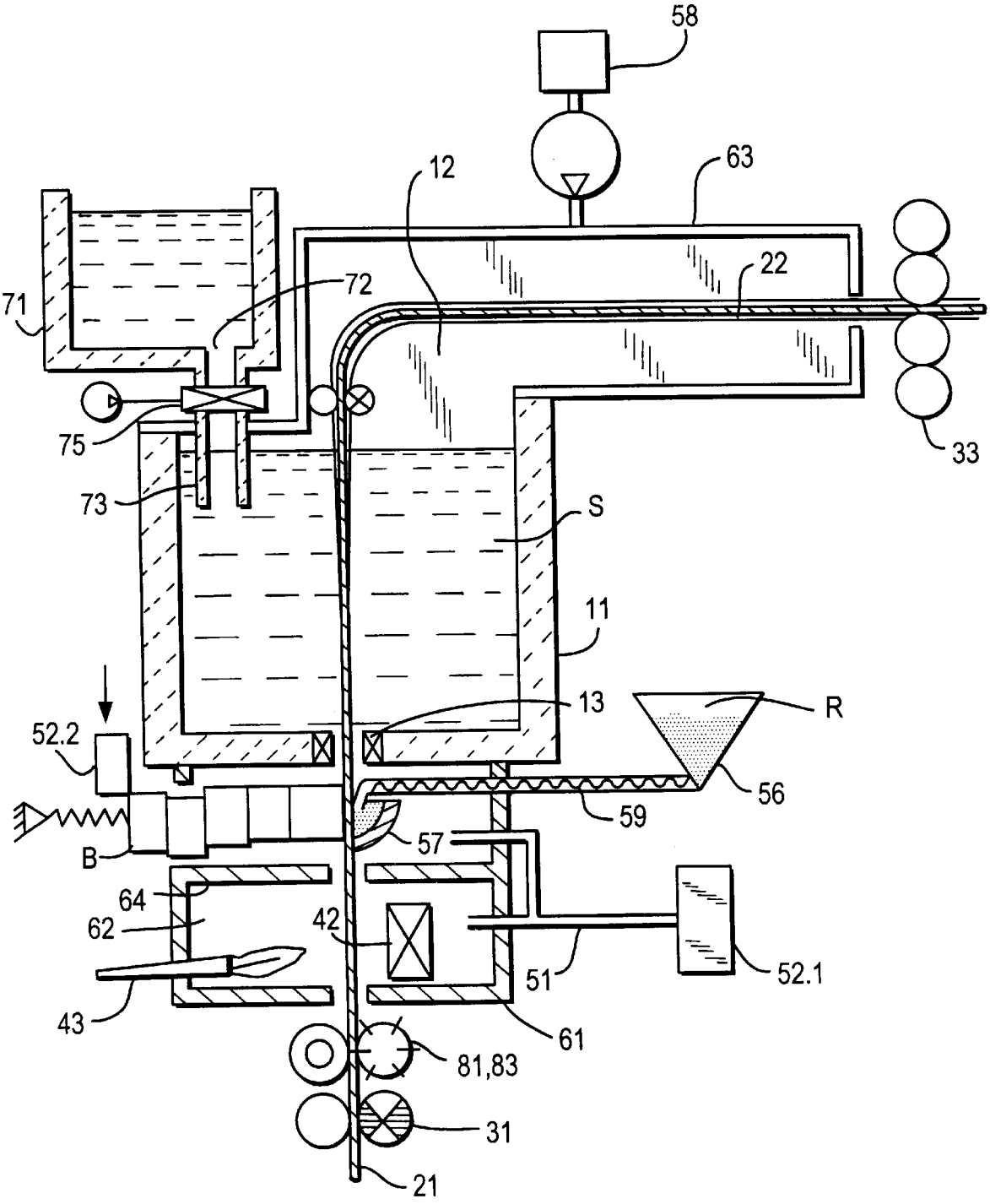
FIG. 3 shows a metallurgic vessel with a feed of solid media.
Figure 4:
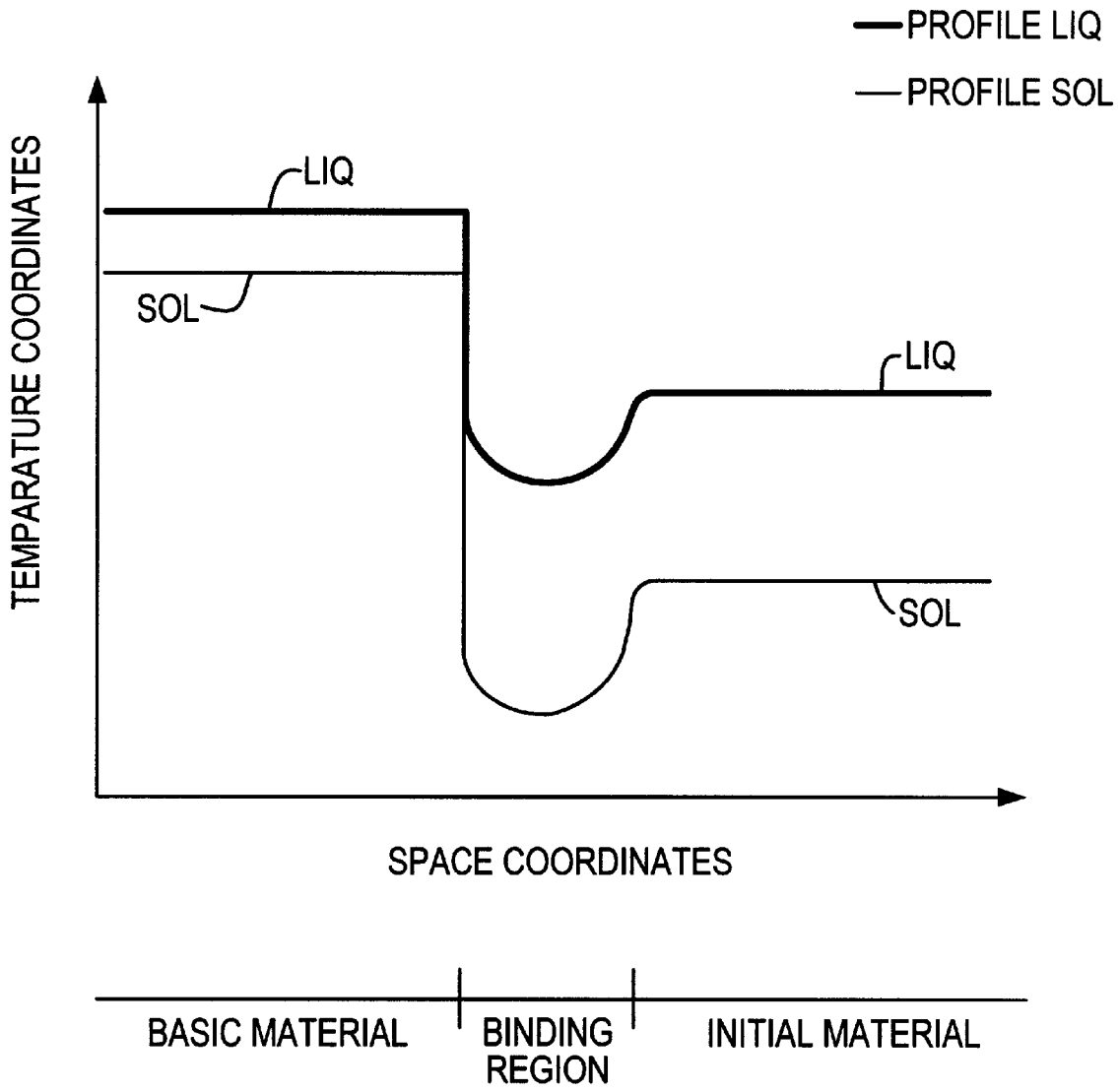
FIG. 4 shows a diagrammatic profile of the local liquidus and solidus temperatures.

FIG. 3 shows a further metallurgic vessel 11 with a bottom passage 13 through which a carrier strip 21 is led. Outside the bottom region of the metallurgic vessel 11 is arranged a housing 61, in which a preheating device in the form of a burner 43 or of an inductive heating system 42 is arranged. The interior 62 of the housing 61 is connected via a media feed 51 to a media supply 52.1 for gaseous media.

Furthermore, the interior 62 is separated from a media feed for solids by means of a horizontal partition 64 serving as heat protection in relation to the bottom region of the metallurgic vessel 11. On the right of the carrier strip 21 is provided a runner 57 which is connected via a worm 59 to a container 56 in which pourable materials are located.

On the left of the carrier strip 21 are solid bodies B, which are capable of being pressed against the surface of the carrier strip 21 by a media supply 52.2.

Also, as shown in FIG. 3, the strip 21 prior to entering the housing 61 can pass through a roughening device 81 which may be in the form of brushes 83.

As in the example according to FIG. 2, the upper orifice 12 of the metallurgic vessel 11 is covered by the hood 63 which is connected to an inert gas supply 58. The hood 63 has dimensions which cover the transport path of the coated carrier strip 22 over a predeterminable distance.

A roll stand 33, by means of which hot forming can be carried out, is indicated diagrammatically outside the hood 63.

The material feed in FIG. 3 is carried out via a ladle 71. In this case, the ladle 71 has a bottom orifice 72, at which is arranged an immersion-type casting spout 73 which is capable of being closed by means of a slide 75 and which penetrates into the melt S.

The terms and expressions which have been employed are used as terms of description and not of limitation, and there is no intention in the use of such terms and expressions of excluding any equivalent of the features shown and described or portions thereof, it being recognized that various modifications are possible within the scope of the invention.

LIST OF ITEMS

Melting bath
11 Metallurgic vessel
12 Upper orifice
13 Bottom passage
Carrier strip
21 Carrier strip
22 Coated carrier strip
23 Winding device
Accessories
31 Pair of feed rollers
32 Pair of discharge rollers
33 Roll stand
41 Preheating device
42 Inductive heating
43 Burner
Media
51 Media feed
52 Media supply
52.1 Media supply for gaseous media
52.2 Media supply for solids
53 Blow nozzles
54 Media conveyor
55 Spray nozzles
56 Container
57 Runner
58 Gas supply
59 Worm
Covering
61 Housing
62 Interior
63 Hood
64 Partition
Material feed
71 Ladle
72 Bottom orifice
73 Immersion-type casting spout
74 Plug
75 Slide
76 Receiving vessel
77 Vacuum distributor
78 Vacuum pump
Roughening
81 Roughening component
82 Sandblaster
83 Brush
84 Blast nozzles
85 Container
86 Pump
Measuring and regulating device
91 Melt temperature
92 Carrier strip temperature
93 Speed
94 Processor
95 Speed, actuator
96 Plug, actuator
97 Measuring device for the melting bath height
S Melt
B Solid body
R Pourable material

What is claimed is:

1. A method for the production of a stripmetallic composite material by a high-temperature dip of a metallic carrier strip, onto the surface of which a thin layer of a melted metallic depositing material with a higher temperature than that of the carrier material is crystallized by solidification comprising:

preheated the carrier strip on its surface;

leading the preheated the carrier strip through a depositing material which is different from the material of the carrier strip wherein while the carrier strip is led through the molten depositing material, a binding region consisting of a gradient material is obtained by means of diffusion actions between the preheated surface of the carrier strip and a crust crystallizing on the surface of the carrier strip, the gradient material having a liquidus temperature, at least in parts of this binding region, below the liquidus temperature of the carrier strip material and of the depositing material, thus giving rise to liquid phase fractions in said region.

2. The method of claim 1, wherein the carrier strip is pretreated by the addition or incorporation of chemical elements.

3. The method of claim 2, wherein the carrier strip surface is prepared by being led through a medium which contains the corresponding chemical elements penetrating at least partially into the surface.

4. The method of claim 3, wherein the medium is a gas.

5. The method of claim 4, wherein the gas is selected from the group consisting of nitrogen, hydrogen, carbon monoxide, ammonia or carbon dioxide.

6. The method of claim 3, wherein the medium is a liquid.

7. The method of claim 6, wherein the liquid is selected from the group consisting of sulfuric acid, liquid ammonia or liquid nitrogen.

8. The method of claim 3, wherein the medium is a solid.

9. The method of claim 8, wherein the solid is selected from the group consisting of cyanogen salt, carbonate or potassium ferrocyanide.

10. The method of claim 1, wherein the carrier strip consists of steel which has a carbon content>20 ppm in the region of its surface.

11. The method of claim 1, wherein the carrier strip consists of steel which has a nitrogen content>20 ppm in the region of its surface.

12. The method of claim 1, wherein the carrier strip has a transport speed and/or a penetration depth into the liquid depositing material such that a minimum dipping time of 50 msec is maintained.

13. The method of claim 1, wherein the surface of the carrier strip is roughened prior to contacting the liquid depositing material.

14. The method of claim 1, wherein the carrier strip is a carbon-containing steel and is preheated to a temperature of >900° C. at least on its surface.

15. The method of claim 1, wherein the depositing material is a high alloyed steel.

16. The method of claim 15 wherein the high alloyed steel is a chromium alloyed steel.

17. A system for the production of a strip metallic composite material by high-temperature dip coating of a metallic carrier strip comprising:

a metallurgic vessel for receiving a liquid depositing material, said vessel having an entry and an exit side;

pairs of rollers arranged on the entry and the exit side through which a carrier strip is led in a preferably vertical run-through direction through said vessel;

a preheating device for the carrier strip, said preheating device being located upstream of the metallurgic vessel and being arranged in a housing which is arranged in the entry region upstream of the metallurgic vessel and surrounds the carrier strip and into which the medium coming from a media supply is capable of being introduced via at least one feed led into the housing;

measuring elements for detecting the melt temperature, the temperature of the carrier strip and its speed;

at least one actuator for setting the speed of the carrier strip, said measuring elements controlling via a processor, said least one actuator;

a feed having at least one of blow nozzles for injecting a gaseous medium into the interior of the housing and/or onto the surface of the carrier strip or spray nozzles for spraying a liquid medium onto the surface of the carrier strip, or wherein pourable solids are capable of being introduced into runners via the feed, the solids being capable of being brought into contact with the surface of the carrier strip, or wherein, alternatively, the medium is capable of being pressed as a rechargeable solid body against the surface of the carrier strip.

18. The system of claim 17, further comprising a roughening device upstream of the metallurgic vessel for roughening the surface of the carrier strip.

19. The system of claim 18, wherein the roughening device is a sandblaster.

20. The system of claim 18, wherein the roughening device comprises brushes or the like.

21. The system of claim 17, further comprising a hood which covers the metallurgic vessel and which is connected to a gas supply for the supply of inert gas and which encases the coated carrier strip during the solidification of the surface of the latter.

22. The system of claim 17, further comprising at least one roll stand located downstream of the metallurgic vessel in the take-off direction of the carrier strip.

23. A strip metallic composite material, comprising: a stainless steel strip; a markedly thinner layer of metallic depositing material crystallized onto the strip wherein the metallic depositing material on at least one side of the strip has a thickness ($d_A$) of $d_A$=(0.01 to 0.3)×D wherein D is the thickness of the steel strip and, wherein a binding layer has a thickness ($d_B$) of $d_B$=5 to 150 $\mu$m, and wherein the binding layer has a toothed line which additionally bonds positively the binding layer to the strip and to the depositing layer.

24. The strip metallic composite material of claim 23, wherein there is a continuous transfer of alloying elements between the strip and the coating material.

* * * * *